US008576029B2

(12) United States Patent
Kishore et al.

(10) Patent No.: US 8,576,029 B2
(45) Date of Patent: Nov. 5, 2013

(54) MEMS SWITCHING ARRAY HAVING A SUBSTRATE ARRANGED TO CONDUCT SWITCHING CURRENT

(75) Inventors: Kuna Venkat Satya Rama Kishore, Hyderabad (IN); Marco Aimi, Niskyuna, NY (US)

(73) Assignee: General Electric Company, Niskayuna, NY (US)

( * ) Notice: Subject to any disclaimer, the term of this patent is extended or adjusted under 35 U.S.C. 154(b) by 82 days.

(21) Appl. No.: 12/817,578

(22) Filed: Jun. 17, 2010

(65) Prior Publication Data

US 2011/0308924 A1 Dec. 22, 2011

(51) Int. Cl.
*H01H 51/22* (2006.01)
*H01H 57/00* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 6,384,353 | B1 * | 5/2002 | Huang et al. | 200/181 |
| 6,504,118 | B2 * | 1/2003 | Hyman et al. | 200/181 |
| 6,778,046 | B2 * | 8/2004 | Stafford et al. | 335/78 |
| 6,809,412 | B1 * | 10/2004 | Tourino et al. | 257/678 |
| 6,872,902 | B2 * | 3/2005 | Cohn et al. | 200/181 |
| 7,022,542 | B2 * | 4/2006 | Combi et al. | 438/52 |
| 7,042,319 | B2 * | 5/2006 | Ishiwata et al. | 335/78 |
| 7,151,426 | B2 * | 12/2006 | Stafford et al. | 335/78 |
| 7,170,155 | B2 * | 1/2007 | Heck et al. | 257/684 |
| 7,297,571 | B2 * | 11/2007 | Ziaei et al. | 438/106 |
| 7,332,835 | B1 | 2/2008 | Wright et al. | |
| 7,388,281 | B2 * | 6/2008 | Krueger et al. | 257/678 |
| 7,531,439 | B2 | 5/2009 | Rieger et al. | |
| 7,554,154 | B2 | 6/2009 | Hebert | |
| 7,560,783 | B2 | 7/2009 | Kapels | |
| 7,605,466 | B2 | 10/2009 | Aimi et al. | |
| 7,642,180 | B2 | 1/2010 | Al-Bayati et al. | |
| 7,663,456 | B2 | 2/2010 | Subramanian et al. | |
| 7,667,297 | B2 | 2/2010 | Barthelmess et al. | |
| 7,679,104 | B2 | 3/2010 | Sato et al. | |
| 7,682,918 | B2 | 3/2010 | Cai et al. | |

(Continued)

FOREIGN PATENT DOCUMENTS

| | | | |
|---|---|---|---|
| WO | 2004015728 | A1 | 2/2004 |
| WO | 2006036560 | A2 | 4/2006 |

OTHER PUBLICATIONS

Search Report and Written Opinion from corresponding EP Application No. 11169822.1-2214 dated Aug. 2, 2012.

*Primary Examiner* — Alexander Talpalatski
(74) *Attorney, Agent, or Firm* — Jason K. Klindtworth

(57) ABSTRACT

A micro-electromechanical systems (MEMS) switch or array is provided. A first substrate (e.g., carrier substrate) includes an electrically conductive substrate region. An electrical isolation layer may be disposed over a first surface of the carrier substrate. Movable actuators may be provided. At least one substrate contact is electrically coupled to at least one of the plurality of movable actuators so that a flow of electrical current is established during an electrically-closed condition of the MEMS switch array. A cover substrate may also be provided and includes an electrically conductive substrate region. The electrically conductive region of the carrier substrate is electrically coupled to the electrically conductive region of the cover substrate to define an electrically conductive path for the flow of electrical current during the electrically-closed condition of the switching array.

38 Claims, 4 Drawing Sheets

(56) References Cited

U.S. PATENT DOCUMENTS

| | | | | |
|---|---|---|---|---|
| 7,683,453 | B2 | 3/2010 | Williams et al. | |
| 7,952,041 | B2 * | 5/2011 | Namose | 200/181 |
| 2003/0057544 | A1 * | 3/2003 | Nathan et al. | 257/700 |
| 2003/0151479 | A1 * | 8/2003 | Stafford et al. | 335/78 |
| 2003/0151480 | A1 * | 8/2003 | Orr | 335/78 |
| 2004/0066258 | A1 * | 4/2004 | Cohn et al. | 335/78 |
| 2004/0113727 | A1 * | 6/2004 | Kawai | 335/78 |
| 2004/0157364 | A1 * | 8/2004 | Combi et al. | 438/106 |
| 2004/0207498 | A1 * | 10/2004 | Hyman et al. | 335/78 |
| 2005/0012191 | A1 * | 1/2005 | Gilleo | 257/678 |
| 2005/0225412 | A1 * | 10/2005 | Limcangco | 335/78 |
| 2007/0018761 | A1 * | 1/2007 | Yamanaka et al. | 335/78 |
| 2007/0057746 | A1 | 3/2007 | Rubel | |
| 2008/0017489 | A1 * | 1/2008 | Kawakubo et al. | 200/181 |
| 2008/0191293 | A1 * | 8/2008 | Liu et al. | 257/415 |
| 2008/0217149 | A1 * | 9/2008 | Schmid et al. | 200/181 |
| 2009/0107812 | A1 * | 4/2009 | Hays et al. | 200/181 |
| 2009/0159410 | A1 | 6/2009 | Wang | |
| 2009/0160584 | A1 | 6/2009 | Premerlani et al. | |

* cited by examiner

MEMS SWITCHING ARRAY HAVING A SUBSTRATE ARRANGED TO CONDUCT SWITCHING CURRENT

FIELD OF THE INVENTION

The present invention is generally related to electrical power switching arrays, and, more particularly, to a micro-electromechanical systems (MEMS) switching array, and, even more particularly, to a MEMS switching array having one or more substrates configured with current-conduction functionality, such as may be suitable to improved packing density and/or flexible interconnectivity for the array components.

BACKGROUND OF THE INVENTION

It is known to connect MEMS switches to form a switching array. An array of switches may be needed because a single MEMS switch may not be capable of either conducting enough current, and/or holding off enough voltage, as may be required for a given switching application.

FIG. 1 is a top view of a known MEMS switching array 10 including a plurality of MEMS switches 12. To form respective current paths in and out of MEMS array 10, a plurality of metal traces 14, electrically coupled to respective input pads 16, and a plurality of metal traces 17, electrically coupled to a plurality output pads 18, may be arranged on a surface of the substrate of MEMS array 10, such as a top surface of the substrate. That is, such input and output current paths are arranged to commonly share the same surface of the substrate.

As can be appreciated from FIG. 1, a relatively large portion of a die area may be needed to accommodate on the same surface such metal traces and pads so that a given MEMS switch array can achieve a desired current and voltage ratings. It will be further appreciated that heat generation in the traces (e.g., I^2R losses) disposed on the same surface tends to limit the number of MEMS switches that can be accommodated in a given die area so that the generated heat can be appropriately dissipated. This limitation can reduce the beam packing density per unit area of the switching array and thus disadvantageously reduce the current-carrying capability of a MEMS switching array.

It will be further appreciated in FIG. 1 that the physical presence of traces 14, 17 may prevent a flexible routing of a gate line coupled to a gate driver 18 for actuating MEMS switches 12. For example, one may have to reroute the gate line by way of loops 19 disposed beyond the respective ends of traces 14, 17 to avoid interference with traces 14, 17. As a consequence of such routing constraints, a designer may have to interconnect in series circuit a relatively long string of MEMS switches, which under certain circumstances could affect the electrical performance of the switching array.

In view of the foregoing considerations, it is desirable to provide an improved MEMS switching array that avoids or reduces the drawbacks discussed above.

BRIEF DESCRIPTION OF THE INVENTION

In one example embodiment thereof, aspects of the present invention are directed to a micro-electromechanical systems (MEMS) switch. The switch may include a first substrate including at least an electrically conductive substrate region. An electrical isolation layer may be disposed on a first surface of the substrate. A substrate contact is electrically coupled to a movable actuator and the electrically conductive region of the first substrate so that a flow of electrical current being switched is established during an electrically-closed condition of the switch. The electrically conductive substrate region of the first substrate defines an electrically conductive path for the flow of electrical current.

In another aspect thereof, a micro-electromechanical systems (MEMS) switch array is provided. A first substrate includes at least an electrically conductive substrate region shared by at least some of the MEMS switch array. An electrical isolation layer may be disposed over a first surface of the first substrate. A plurality of movable actuators is provided. At least one substrate contact is electrically coupled to at least one of the plurality of movable actuators and the electrically conductive region of the first substrate so that a flow of electrical current being switched is established during an electrically-closed condition of the MEMS switch array. The electrically conductive region of the first substrate defines an electrically conductive path for the flow of electrical current.

In yet another aspect thereof, a micro-electromechanical systems (MEMS) switch array is provided. A carrier substrate includes at least an electrically conductive substrate region shared by at least some of the MEMS switch array. An electrical isolation layer may be disposed over a first surface of the carrier substrate. A plurality of movable actuators is provided. At least one substrate contact is electrically coupled to at least one of the plurality of movable actuators so that a flow of electrical current being switched is established during an electrically-closed condition of the MEMS switch array. A cover substrate includes at least an electrically conductive substrate region. The electrically conductive region of the carrier substrate is electrically coupled by way of an interface contact to the electrically conductive region of the cover substrate to define an electrically conductive path for the flow of electrical current during the electrically-closed condition of the switching array.

DETAILED DESCRIPTION OF THE INVENTION

Figure 1:
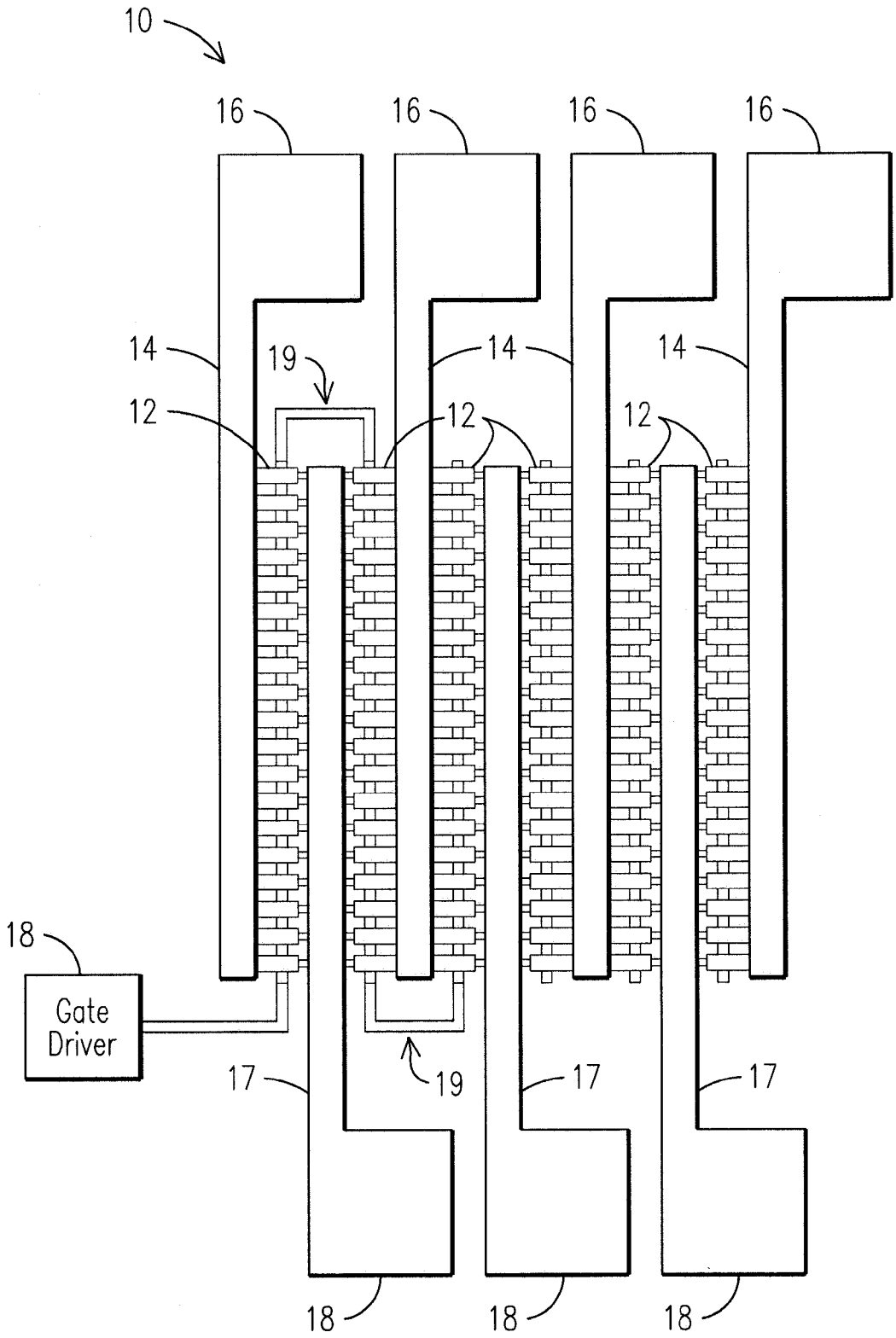
FIG. 1 PRIOR ART
FIG. 1 is a top view of a prior art MEMS switching array where electrically-conductive structures (e.g., pads and conductive traces) for receiving input current into the array and for supplying output current from the array are disposed on a common surface of a substrate of the array.

In accordance with aspects of the present invention, structural and/or operational relationships are described herein, as may be used to establish current flow through a respective thickness of one or more substrates, such as a carrier substrate, or a capping substrate, or both, in a switching array based on micro-electromechanical systems (MEMS) switches. The current flow though the one or more substrates advantageously allows eliminating at least some (or essentially all) of the conductive traces and pads generally constructed on a common surface of the substrate, e.g., a top surface of the substrate. This reduction or elimination of conductive traces and pads is conducive to improving the beam packing density and/or the interconnectivity of a MEMS switching array embodying aspects of the present invention.

Presently, micro-electromechanical systems (MEMS) generally refer to micron-scale structures that for example can integrate a multiplicity of elements, e.g., mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, e.g., structures that may be smaller than 100 nanometers in size. Accordingly, even though example embodiments described throughout this document may refer to MEMS-based devices, it is submitted that the inventive aspects of the present invention should be broadly construed and should not be limited to micron-sized devices.

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. The terms "comprising", "including", "having", and the like, as used in the present application, are intended to be synonymous unless otherwise indicated.

The adjectives "top" and "bottom" may be used for ease of description, e.g., in reference to the drawings; however, use of such adjectives should not be construed as suggestive of spatial limitations. For example, in a practical embodiment, structural features and/or components of the switching array may be arranged partly in one orientation and partly in another. To avoid linguistic constraints, the adjectives "first" and "second" may be used in lieu of the adjectives "top" and "bottom", although the terms "first" and "second" could also be used in an ordinal sense.

Figure 2:
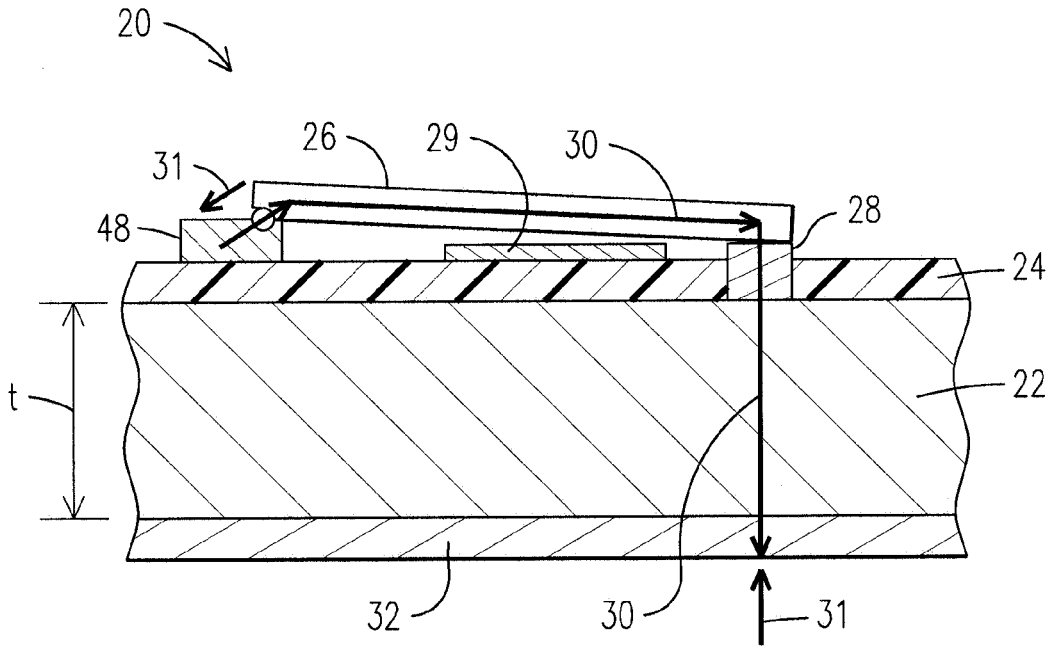
FIG. 2 is a cross sectional view of an example MEMS switch embodying aspects of the present invention.

FIG. 2 is a cross-sectional view of an example micro-electromechanical systems (MEMS) switch 20 embodying aspects of the present invention. MEMS switch 20 is shown in FIGS. 2-3 and FIGS. 5-6 in an electrically-closed (electrically-conducting) condition. In one example embodiment, MEMS switch 20 may comprise at least a first substrate 22 (e.g., a MEMS carrier substrate).

First substrate 22 may be electrically-conductive, as may be formed from a sufficiently doped semiconductor material, such as silicon and germanium, so that the semiconductor behaves as a conductor rather than a semiconductor (a so-called degenerate semiconductor). In one alternate example embodiment, first substrate 22 may be a metallic substrate. An electrical isolation layer 24 may be disposed on a first surface (e.g., a top surface) of first substrate 22. Electrical isolation layer 24 may be formed from silicon nitride, silicon oxide and aluminum oxide. A movable actuator 26 (often referred to as a beam) is provided.

A substrate contact 28 is electrically coupled (ohmic contact) to movable actuator 26 and first substrate 22 so that a flow of electrical current (schematically represented by solid line 30) is established during the electrically-closed condition of the switch. For example, an anchor 48 of MEMS switch 20 may be electrically coupled to a conductive trace (not shown) to receive electrical current to be switched by MEMS switch 20. Arrows 31, in opposite direction to the arrows shown on line 30, are used to symbolically indicate that the current flow may be bidirectional. For example, in one example application the current being switched may flow through movable actuator 26 through contact 28 and downwardly through first substrate 22 and on to an external electrical load (not shown). In another example application, the current may flow upwardly through first substrate 22 to contact 28 and on to movable actuator 26.

Movable actuator 26 may be caused to move toward contact 28 by the influence of a control electrode 29 (also referred to as a gate) positioned on isolation layer 24 below movable actuator 26. As would be appreciated by those skilled in the art, movable actuator 26 may be a flexible beam that bends under applied forces such as electrostatic attraction, magnetic attraction and repulsion, or thermally induced differential expansion, that closes a gap between a free end of the beam and contact 28.

In accordance with aspects of the present invention, first substrate 22 may define an electrically conductive path in the substrate for the flow of electrical current. An interface layer 32, as may be configured to provide ohmic contact to first substrate 22, may be disposed on a second surface (e.g., a bottom surface) of first substrate 22. In one embodiment, the second surface of the substrate is positioned opposite the first surface of the substrate. In the example case of a metallic substrate, interface layer 32 may not be needed since the ohmic contact functionality provided by interface layer 32 may be directly provided by the bottom surface of such a metallic substrate.

As shown in FIG. 2, the electrically conductive path may extend across a thickness of first substrate 22 (as may be represented by the line labeled with the letter "t") so that the flow of electrical current passes across the thickness of the substrate to interface layer 32. In one example embodiment, the electrically conductive path in the substrate may comprise conductivity in a range from approximately 1 ohm-cm to approximately 10E-6 ohm-cm.

It will be appreciated that the entire substrate 22 need not be an electrically-conductive substrate since, for example, it is contemplated that just a respective substrate region, such as beneath substrate contact 28 and extending across the thickness of the substrate, may be arranged to be electrically conductive. Accordingly, in one example embodiment one can engineer substrate 22 to include a region having a relatively high doping (e.g., the electrically-conductive region beneath substrate contact 28 and through the thickness of the substrate). As described in greater detail below, it will be appreciated that the electrically conductive path provided by first substrate 22 need not be limited to the example arrangement shown in FIG. 2.

Figure 3:
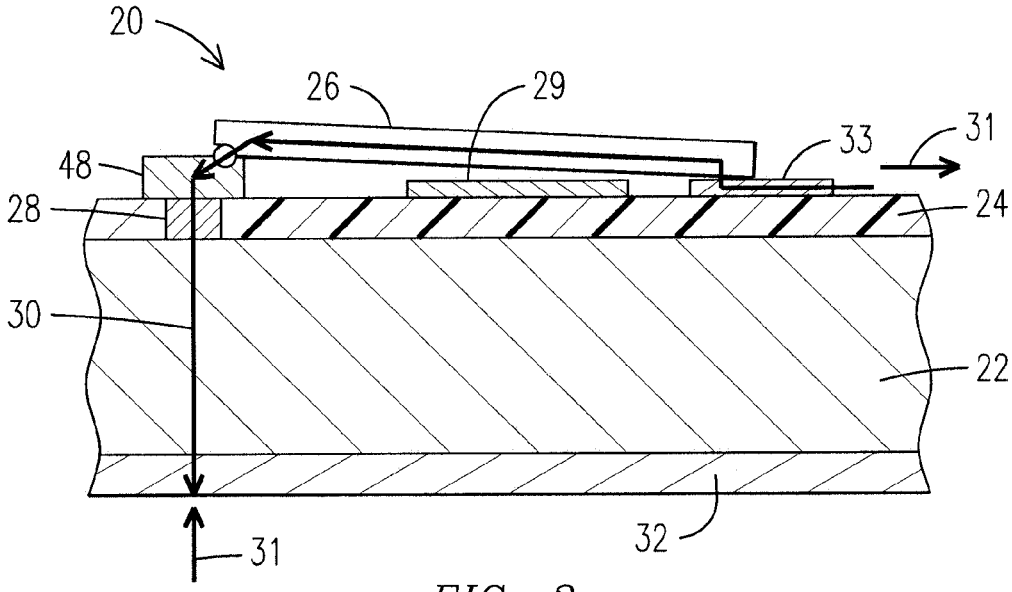
FIG. 3 is a cross sectional of another example MEMS switch embodying aspects of the present invention.

FIG. 3 illustrates an example embodiment where substrate contact 28 is electrically coupled (ohmic contact) to anchor 48 and first substrate 22 so that a flow of electrical current (schematically represented by solid line 30) is established during the electrically-closed condition of the switch. Once again, arrows 31, in opposite direction to the arrows shown in solid line 30, are used to symbolically indicate that the current flow may be bidirectional. For example, in one example application the current may flow through anchor 48 through contact 28 and downwardly through first substrate 22. In another example application, the current may flow upwardly through first substrate 22 through contact 28, through anchor 48 and on through movable actuator 26. In this example embodiment, a beam contact 33 may be electrically coupled to a conductive trace (not shown).

Figure 4:
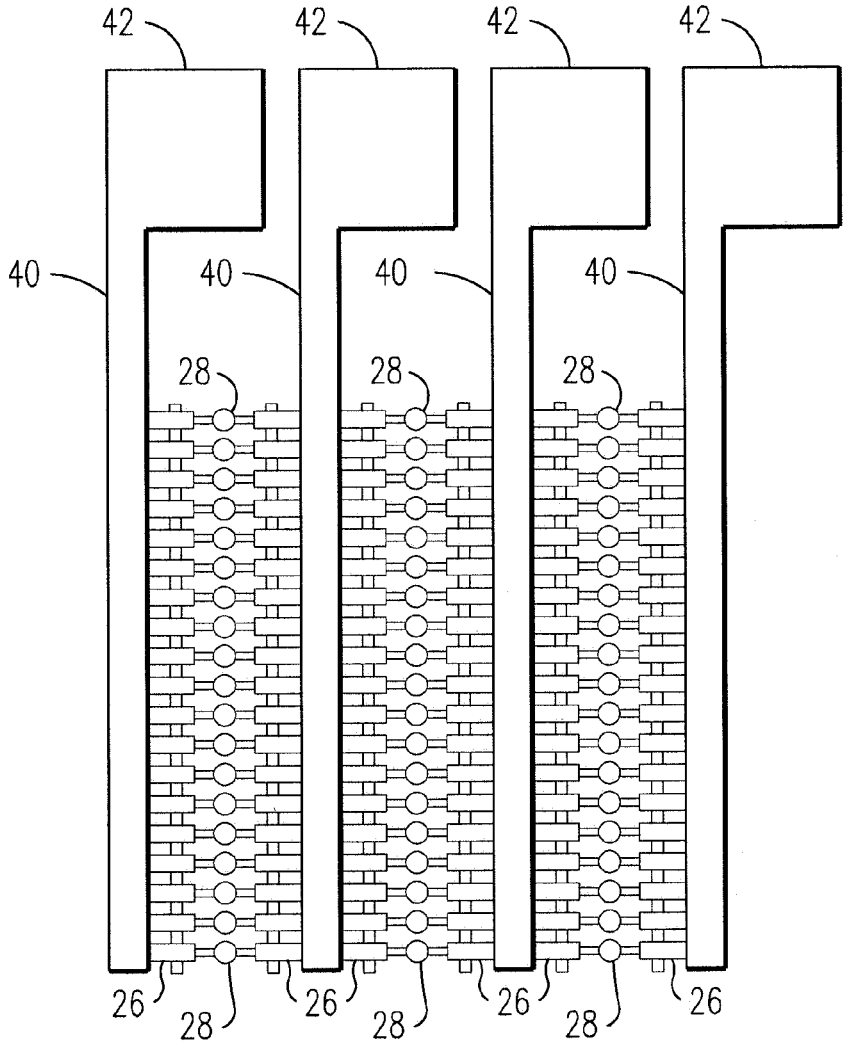
FIG. 4 is a top view of a MEMS switching array embodying aspects of the present invention where at least some of the electrically-conductive structures (e.g., pads and conductive traces) typically used for receiving input current into the array (or for supplying output current) from the array may be eliminated.

FIG. 4 is a top view of a MEMS switch array embodying aspects of the present invention. In one example embodiment, a plurality of conductive traces 40 and pads 42 are electrically coupled to a plurality of movable actuators 26. The plurality of conductive traces 40 and pads 42 may be disposed on the electrical isolation layer on the first surface (e.g., top surface) of the substrate.

In one example embodiment, conductive traces 40 and pads 42 located on the top surface of the substrate may be arranged as respective input paths to the current flow, and interface layer 32 (FIGS. 2 and 3) located on the bottom surface of the substrate may provide an output path to the current flow. That is, this example embodiment would advantageously eliminate the output conductive traces and/or pads normally used on the on the top surface of the substrate. In another example embodiment, conductive traces 40 and pad 42 located on the top surface of the substrate may be arranged as respective output paths to the current flow, and interface layer 32 may provide an input path to the current flow. That is, this example embodiment would advantageously eliminate input conductive traces and/or pads normally used on the top surface of the substrate.

By way of example, the through-thickness current flow that is established in the electrically conductive substrate advantageously allows to reduce approximately by one-half the structural features (conductive traces and/or pads) previously used on the top surface of the substrate for passing input/output current in the switching array. For comparative purposes, a simple visual comparison of FIG. 4 and FIG. 1 should enable an observer to appreciate a substantial reduction of die area (FIG. 4) that otherwise would be used up when the input pads and associated traces together with the output pads and associated traces are disposed on the same surface of the substrate (FIG. 1).

The description below builds on the concepts described so far in the example context of a first substrate (e.g., a carrier substrate). More particularly, the description below illustrates example embodiments conducive to a MEMS switching array, where a MEMS carrier substrate is arranged with a second substrate (e.g., a capping or cover substrate). For readers desirous of general background information in connection with sealing and packaging of MEMS devices, as may use a carrier substrate and a capping substrate, reference is made to U.S. Pat. No. 7,605,466 commonly assigned to the same assignee of the present invention and herein incorporated by reference.

Figure 5:
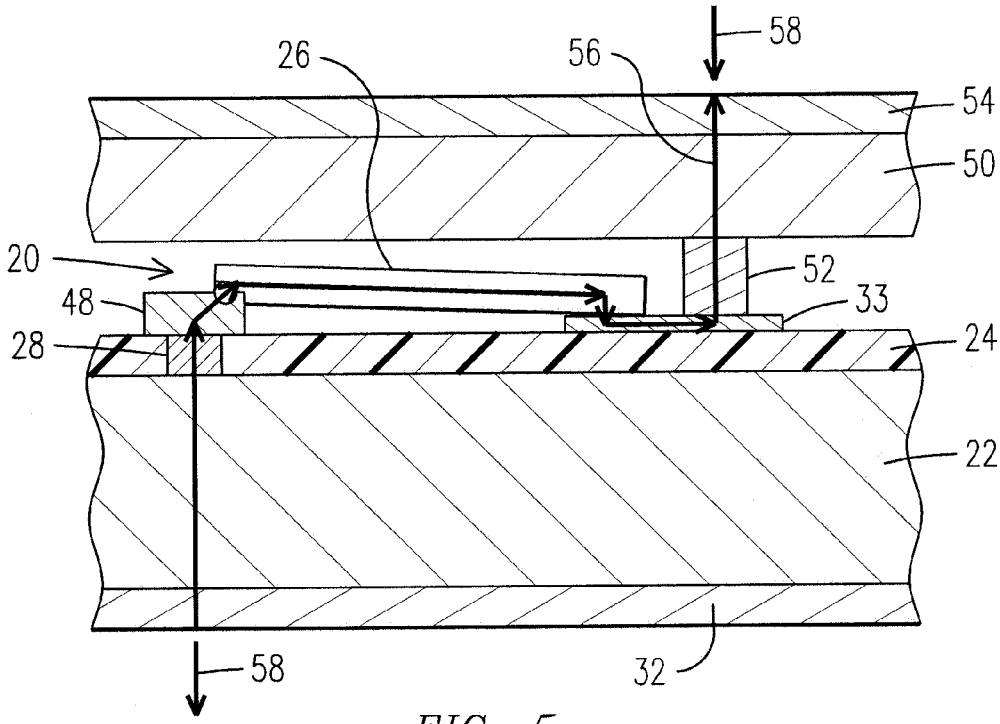
FIG. 5 is a cross sectional view of an example of a MEMS switch having a first substrate (e.g., a carrier substrate) and a second substrate (e.g., a cap substrate) embodying aspects of the present invention.

FIG. 5 is a cross-sectional view of an example microelectromechanical systems (MEMS) switch 20 as may be carried by first substrate 22 (e.g., a carrier substrate) and covered (e.g., hermetically sealed) by a second substrate 50 (e.g., a capping substrate). In this example embodiment, when MEMS switch 20 is in an electrically-closed condition, movable actuator 26 engages beam contact 33, which is electrically coupled to an inter-substrate contact 52. That is, inter-substrate contact 52 is a contact arranged to electrically couple first substrate 22 to second substrate 50, which, (essentially as described in the context of first substrate 22) may be an electrically-conductive substrate, or may be engineered to include just a respective electrically conductive substrate region, such as above inter-substrate contact 52 and extending across the thickness of substrate 50 to support a flow of electrical current. An interface layer 54, to provide suitable ohmic contact to second substrate 50, may be disposed on a top surface of second substrate 50. In the example case of a metallic capping substrate, interface layer 54 may not be needed since the ohmic contact functionality provided by interface layer 54 may be directly provided by the top surface of such a metallic capping substrate.

In accordance with aspects of the present invention, first substrate 22 and second substrate 50 cooperate to jointly define an electrically conductive path for the flow of electrical current (schematically represented by solid line 56), which advantageously allows to eliminate essentially all input/output pads 16, 18 and metal traces 14, 17, (FIG. 1). Arrows 58, in opposite direction to the arrows shown on line 56, are used to symbolically indicate that the current flow may be bidirectional. For example, in one example application the current being switched may vertically flow through first substrate 22, through substrate contact 28 through movable actuator 26 through inter-substrate contact 52 and vertically through second substrate 50. In another example application, the current may flow downwardly through first substrate 50 through inter-substrate contact 52 to movable actuator 26 and on to first substrate 22.

Figure 6:
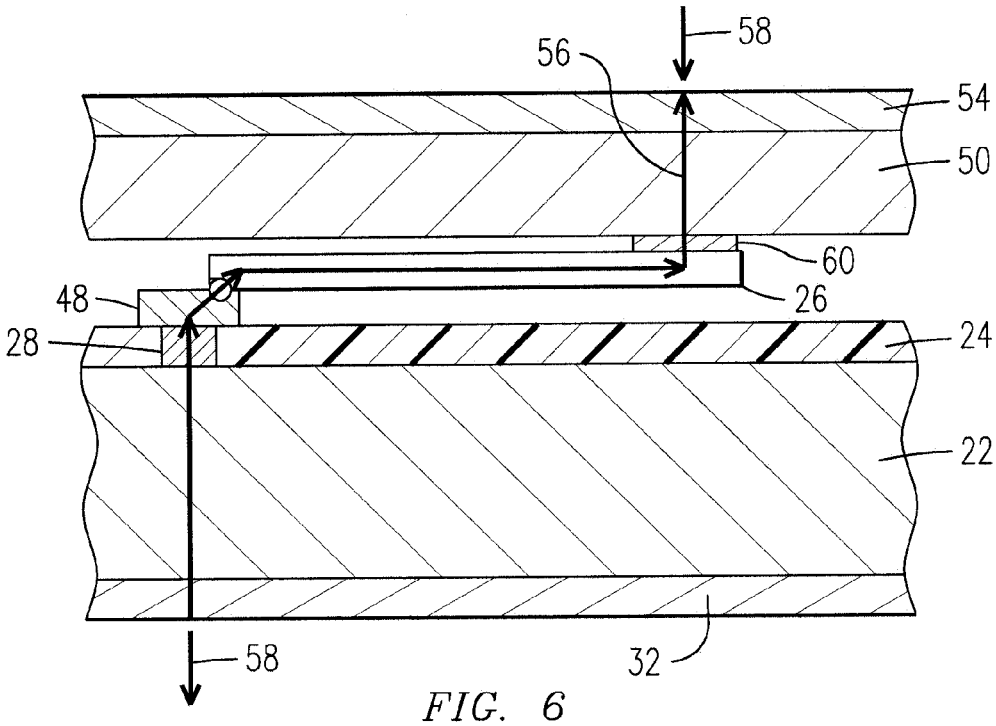
FIG. 6 is a cross sectional view of another example of a MEMS switch having first and second substrates embodying aspects of the present invention.

FIG. 6 is a cross-sectional view of an example microelectromechanical systems (MEMS) switch 20 embodying aspects of the present invention. This example embodiment also includes first substrate 22 (e.g., a carrier substrate) and second substrate 50 (e.g., a capping substrate), as discussed in the context of FIG. 5. In this example embodiment, in lieu of inter-substrate contact 52, a beam contact 60 may be disposed on a bottom surface of second substrate 50 so that when MEMS switch 20 is in an electrically-closed condition, the free end of movable actuator 26 moves upwardly to engage beam contact 60, which is electrically coupled to second substrate 50 and permits establishing a current flow as schematically represented by solid line 56. Arrows 58, in opposite direction to the arrows shown on line 56, are used to symbolically indicate that the current flow may be bidirectional. For example, in one example application the current being switched may vertically flow through first substrate 22, through substrate contact 28, through movable actuator 26 through beam contact 60 and vertically through second substrate 50. In another example application, the current may flow downwardly through second substrate 50 through beam contact 60 to movable actuator 26 and on to first substrate 22.

Figure 7:
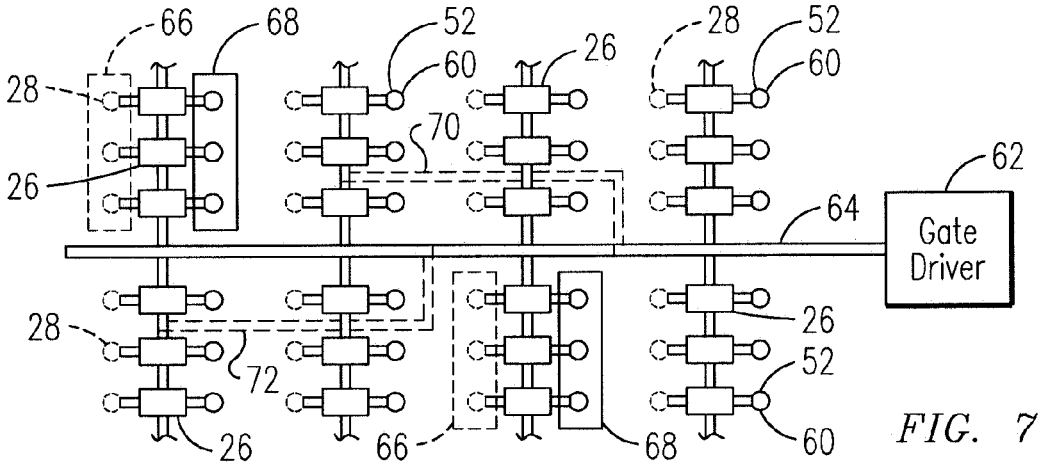
FIG. 7 is a top view of a MEMS switching array embodying aspects of the present invention where electrically-conductive structures (e.g., pads and conductive traces) for receiving input current into the array and for supplying output current from the array are effectively eliminated.

FIG. 7 is a top view of a MEMS switching array embodying aspects of the present invention where, as described in the context of FIGS. 4 and 5, first substrate 22 and second substrate 50 cooperate to jointly define an electrically conductive path for the flow of electrical current. For simplicity of visualization, the capping substrate has been removed from the view shown in FIG. 7. Essentially, the electrically conductive paths respectively provided by first substrate 22 and second substrate 50 in combination with substrate connecting means, such as substrate contacts 28, inter-substrate contact 52 (or substrate contact 60) allow to effectively eliminate electrically-conductive structures (e.g., input/output pads and conductive traces) for receiving input current into the array and for supplying output current from the array. Rectangle 66 is a conceptual representation of substrate connecting means electrically coupled to first substrate 22, such as substrate contacts 28. Rectangle 68 is a conceptual representation of substrate connecting means mechanically coupled to second substrate 50, such as inter-substrate contact 52 or substrate contact 60.

FIG. 7 further illustrates a gate driver 62 coupled through a gating line 64 to drive the respective gating electrodes for actuating movable actuators 26 of a number of MEMS switches of the switch array. It will be now appreciated by those skilled in the art that a MEMS switching array embodying aspects of the present invention can provide substantial interconnecting flexibility to the designer. For example, elimination of traces 14, 17 (FIG. 1) allows the designer to flexibly route gating line 64 without having to make burdensome rerouting (e.g., looping arrangements) of such a line. Moreover, as a result of such interconnecting flexibility, the designer may now more finely select the size and/or the interconnecting arrangement of the MEMS switches to be used in a given switching application. For example, in the example prior art circuitry shown in FIG. 1, the designer may be forced to use a relatively long string of serially connected MEMS switches (e.g., the switches located in the columns of the switching array would be connected to one another in series circuit) to avoid interference of the gating line with traces 14, 17. A relatively long string of serially connected MEMS switches in certain circumstances could affect electrical performance of the switching array.

In accordance with further aspects of the present invention, one may flexibly route gating line 64 to actuate any desired combination of series and/or parallel circuit interconnections of the MEMS switches of the switching array. That is, being that the example embodiment shown in FIG. 7 lacks traces 14, 17, the designer may now freely route gating line 64, as may be conceptually visualized by way of example dashed gating lines 70, 72, to actuate a desired combination of series and/or parallel circuit interconnecting arrangements for the number of MEMS switches coupled to the gating line.

A non-limiting example application of a MEMS switch array embodying aspects of the present invention may be an alternating current (AC) power switch, where the frequency value of the current being switched comprises a power line frequency, such as 60 Hz or 50 Hz (e.g., a relatively low-frequency, non-radio frequency). Another example application of a MEMS switch array embodying aspects of the present invention may be a direct current (DC) power switch.

It is noted that such power-switching applications may particularly benefit from a MEMS switch array embodying aspects of the present invention. For example, each of the electrically conductive paths in the substrate carries a portion of the overall current being switched by the MEMS switch array. The through-thickness conductivity in the substrate should not be analogized to vertical vias structures commonly constructed in a substrate, where such vias structures are typically electrically isolated from one another to provide signal isolation to the signals carried by such vias. In accordance with aspects of the present invention, no such signal isolation is required being that the electrically conductive paths in the substrate each carries a respective portion of the overall current being switched by the MEMS switch array.

While various embodiments of the present invention have been shown and described herein, it will be understood that such embodiments are provided by way of example only. Numerous variations, changes and substitutions may be made without departing from the invention herein. Accordingly, it is intended that the invention be limited only by the spirit and scope of the appended claims.

What is claimed is:

1. A micro-electromechanical systems (MEMS) switch comprising:

a first electrically conductive substrate without via structures being disposed in the electrically conductive substrate;

an electrical isolation layer having a first surface disposed on a first surface of the substrate;

a movable actuator disposed proximate a second surface of the electrical isolation layer opposite the first surface of the electrical isolation layer; and a substrate contact electrically coupled to the movable actuator and passing through the electrical isolation layer to be electrically coupled to the electrically conductive substrate so that a flow of electrical current being switched is established during an electrically-closed condition of the switch, wherein the electrically conductive substrate defines an electrically conductive path for the flow of electrical current.

2. The MEMS switch of claim 1, further comprising an ohmic interface layer disposed on a second surface of the substrate for passing the flow of electrical current.

3. The MEMS switch of claim 1, wherein the electrically conductive path comprises a first and a second end selectively interconnected by the switch, the first and second ends of the electrically conductive path being disposed on opposed sides of the electrically conductive substrate, so that the flow of electrical current passes across the thickness of the electrically conductive substrate.

4. The MEMS switch of claim 1, wherein the substrate contact is positioned so that a free end of the movable actuator is electrically coupled to the substrate contact during the electrically-closed condition of the switch.

5. The MEMS switch of claim 1, wherein the substrate contact is positioned to be electrically coupled to the movable actuator through an anchor of the switch.

6. The MEMS switch of claim 1, wherein the first substrate comprises a MEMS carrier substrate.

7. The MEMS switch of claim 1, further comprising a second electrically conductive substrate without via structures being disposed in the second substrate, wherein the first substrate is electrically coupled by way of an interface contact with the second substrate to jointly define the electrically conductive path for the flow of electrical current during the electrically-closed condition of the switch.

8. The MEMS switch of claim 7, wherein said interface contact comprises an inter-substrate contact arranged to electrically couple the first substrate to the second substrate to pass the flow of electrical current during the electrically-closed condition of the switch.

9. The MEMS switch of claim 7, wherein said interface contact comprises a beam contact disposed on a second surface of the second substrate, the beam contact arranged to electrically couple a free end of the movable actuator to said at least electrically conductive region of the second substrate during the electrically-closed, condition of the switch.

10. The MEMS switch of claim 7, wherein the substrate contact, or interface contact comprises a respective ohmic contact.

11. The MEMS switch of claim 7, wherein the MEMS switch comprises an alternating current (AC) power switch and a frequency value of the current being switched comprises a power line frequency.

12. The MEMS switch of claim 7, wherein the MEMS switch comprises a direct current (DC) power switch.

13. The MEMS switch of claim 7, wherein the second substrate comprises a cover substrate.

14. A micro-electromechanical systems (MEMS) switch array comprising:

a first electrically conductive substrate without via structures being disposed in the electrically conductive substrate, the electrically conductive substrate shared by at least some of the MEMS switch array;

an electrical isolation layer having a first surface disposed over a first surface of the first substrate;

a plurality of movable actuators disposed proximate a second surface of the electrical isolation layer opposite the first surface of the electrical isolation layer;

at least one substrate contact electrically coupled to at least one of the plurality of movable actuators and passing through the electrical isolation layer to be electrically coupled to the electrically conductive substrate so that a flow of electrical current being switched is established during an electrically-closed condition of the MEMS switch array, wherein said at least electrically conductive substrate of the first substrate defines an electrically conductive path for the flow of electrical current.

15. The MEMS switch array of claim 14, wherein said at least one substrate contact is positioned so that a free end of said at least one of the plurality of movable actuators is electrically coupled to said at least one substrate contact during the electrically-closed condition of the switching array.

16. The MEMS switch array of claim 14, wherein said at least one substrate contact is positioned to be electrically coupled to said at least one of the plurality of movable actuators through at least one anchor of the switching array.

17. The MEMS switch array of claim 14, further comprising a second electrically conductive substrate without via structures being disposed in the second substrate, wherein the first substrate is electrically coupled by way of an interface contact to the second substrate to define the electrically conductive path for the flow of electrical current during the electrically-closed condition of the switching array.

18. The MEMS switch array of claim 14, wherein the first substrate comprises a MEMS carrier substrate and the second first substrate comprises a cover substrate.

19. The MEMS switch array of claim 17, wherein the electrically conductive path comprises a first end and a second end selectively interconnected by the switch, the first and second ends of the electrically conductive path being disposed on opposed sides of the carrier and cover substrates, so that the flow of electrical current passes across respective thicknesses of the first and second substrates.

20. The MEMS switch array of claim 17, further comprising an ohmic interface layer disposed on a second surface of the first substrate and an ohmic interface disposed on a first surface of the second substrate for passing the current flow being switched.

21. The MEMS switch array of claim 17, wherein the interface contact comprises at least one inter-substrate contact arranged to electrically couple the first substrate to the second substrate.

22. The MEMS switch array of claim 17, wherein the interface contact comprises at least one beam contact disposed on a first surface of the second substrate, said at least one beam contact arranged to electrically couple a free end of said at least one of the plurality of movable actuators to the second substrate during the electrically-closed condition of the switching array.

23. The MEMS switch array of claim 17, wherein the substrate contact or interface contact comprises an ohmic contact.

24. The MEMS switch array of claim 14, wherein the MEMS switch array comprises an alternating current (AC) power switching array and a frequency value of the current comprises a power line frequency.

25. The MEMS switch array of claim 14, wherein the MEMS switch array comprises a direct current (DC) power switching array.

26. The MEMS switch array of claim 14, further comprising a gating line coupled to actuate a number of MEMS switches of the switch array, wherein the gating line is freely routed to actuate a desired combination of series and/or parallel circuit interconnecting arrangements for the number of MEMS switches coupled to the gating line.

27. A micro-electromechanical systems (MEMS) switch array comprising:

an electrically conductive carrier substrate without via structures being disposed in the carrier substrate, the electrically conductive substrate shared by at least some of the MEMS switch array;

an electrical isolation layer having a first surface disposed over a first surface of the carrier substrate;

a plurality of movable actuators disposed proximate a second surface of the electrical isolation layer opposite the first surface of the electrical isolation layer;

at least one substrate contact electrically coupled to at least one of the plurality of movable actuators and passing through the electrical isolation layer to be electrically coupled to the carrier substrate so that a flow of electrical current being switched is established during an electrically-closed condition of the MEMS switch array; and an electrically conductive cover substrate without via structures being disposed in the cover substrate, wherein the carrier substrate is electrically coupled by way of an interface contact to the cover substrate to define an electrically conductive path for the flow of electrical current during the electrically-closed condition of the switching array.

28. The MEMS switch array of claim 27, wherein the electrically conductive path comprises a first end and a second end selectively interconnected by the switch, the first and second ends of the electrically conductive path being disposed on opposed sides of the carrier and cover substrates, so that the flow of electrical current passes across respective thicknesses of the carrier and cover substrates.

29. The MEMS switch array of claim 27, further comprising an ohmic interface layer disposed on a second surface of the carrier substrate and an ohmic interface disposed on a first surface of the cover substrate for passing the current flow being switched.

30. The MEMS switch array of claim 27, wherein said at least one substrate contact is positioned so that a free end of said at least one of the plurality of movable actuators is electrically coupled to said at least one substrate contact during the electrically-closed condition of the switching array.

31. The MEMS switch array of claim 27, wherein said at least one substrate contact is positioned to be electrically coupled to said at least one of the plurality of movable actuators through at least one anchor of the switching array.

32. The MEMS switch array of claim 27, wherein the interface contact comprises at least one inter-substrate contact arranged to electrically couple the first substrate to the second substrate.

33. The MEMS switch array of claim 27, wherein the interface contact comprises at least one beam contact disposed on a first surface of the second substrate, said at least one beam contact arranged to electrically couple a free end of said at least one of the plurality of movable actuators to the second substrate during the electrically-closed condition of the switching array.

34. The MEMS switch array of claim 27, wherein the substrate contact or interface contact comprises a respective ohmic contact.

35. The MEMS switch array of claim 27, further comprising a gating line coupled to actuate a number of MEMS switches of the switch array, wherein the gating line is freely routed to actuate a desired combination of series and/or parallel circuit interconnecting arrangements for the number of MEMS switches coupled to the gating line.

36. The MEMS switch of claim 1, wherein the electrically conductive substrate of the first substrate comprises a semiconductor material sufficiently doped to behave as a conductor.

37. The MEMS switch of claim 1, wherein the electrically conductive substrate of the first substrate comprises a metallic substrate.

38. A MEMS device comprising:

substrate supporting a MEMS switch, the substrate being formed of an electrically conductive material;

an electrically conductive path comprising an input end and an output end selectively interconnected by switch, the input and output ends of the electrically conductive path being disposed on opposed sides of the electrically conductive substrate, so that current conducted by the switch between the input and output ends of the electrically conductive path passes through a thickness of the electrically conductive substrate;

a layer of insulating material disposed on a surface of the electrically conductive material;

a conductive anchor disposed on the layer of insulating material;

an actuator connected to the conductive anchor; and a conductive substrate contact passing through the layer of insulating material and making contact with the substrate;

wherein the actuator is selectively movable into and out of contact with the conductive substrate contact to selectively connect and disconnect the input and output ends of the electrically conductive path.

* * * * *